US005759120A

United States Patent [19]

Mathis et al.

[11] Patent Number: 5,759,120

[45] Date of Patent: Jun. 2, 1998

[54] MULTI-FUNCTION GOLFER'S TOOL

[76] Inventors: James E. Mathis, P.O. Box 100, Union, S.C. 29379; Charles M. Lykins, 5920 Shirley St., Naples, Fla. 34109; Ronald W. Rose, 2077 Pine Ridge Rd., Naples, Fla. 33942

[21] Appl. No.: 795,670

[22] Filed: Feb. 6, 1997

[51] Int. Cl.[6] ..... A63B 57/00

[52] U.S. Cl. ..... 473/408; 131/248

[58] Field of Search ..... 473/406, 407, 473/408, 286, 285, 284, 387; D21/234; 131/248, 250, 187

[56] References Cited

U.S. PATENT DOCUMENTS

| | | | |
|---|---|---|---|
| 873,365 | 12/1907 | Gast . | |
| 1,109,073 | 9/1914 | Lebréche . | |
| 1,135,318 | 4/1915 | Peter . | |
| 3,774,913 | 11/1973 | Dien | 473/286 |
| 3,903,598 | 9/1975 | Lefebvre . | |
| 4,063,731 | 12/1977 | Kitay . | |
| 5,143,371 | 9/1992 | Straham . | |
| 5,152,524 | 10/1992 | Brown | 473/286 |
| 5,226,647 | 7/1993 | Notarmuzi . | |
| 5,401,019 | 3/1995 | Wissman et al. . | |
| 5,405,133 | 4/1995 | Upton . | |
| 5,562,553 | 10/1996 | Digerness et al. | 473/408 |
| 5,588,448 | 12/1996 | Photakis | 473/387 |
| 5,643,114 | 7/1997 | Marcus | 473/408 |

*Primary Examiner*—Steven B. Wong
*Attorney, Agent, or Firm*—Kennedy Covington Lobdell & Hickman, LLP

[57] ABSTRACT

A multi-function golfer's cigar tool includes a body with a cigar cutter having a blade movably mounted therein, an arrangement for repairing a ball mark on a golf course associated with the body, a cigar support stand and a golf club support stand.

13 Claims, 6 Drawing Sheets

MULTI-FUNCTION GOLFER'S TOOL

BACKGROUND OF THE INVENTION

The present invention relates broadly to multi-function tools for golfers and smokers and, more particularly, to a multi-function golfer's cigar tool including a cigar cutter, a turf repair tool, a cigar stand and a club handle support.

Typically, golfers use a variety of tools which are ancillary to the primary tools of the golfer, namely clubs and balls. Golfers may use ball washers, cleat cleaners, and probably most commonly, a turf repair tool. Such turf repair tools include two extending prongs which are used to repair a ball mark depression in a golf course resulting from the impact of a golf ball landing on the green thereby relieving the green of a surface irregularity that may adversely effect the putting conditions. Such tools may be formed as pocket-sized devices with hidden or otherwise protected prongs. Such a device is disclosed in Upton, U.S. Pat. No. 5,405,133 where a folding ball mark repair tool is formed with a switchblade type mechanism.

Another group of hobbyists who employ a number of tools are smokers, more particularly, cigar smokers. Among these tools is a cutter which is used to snip the end off the cigar to provide an air passage.

Given the current proliferation of cigar smoking, more and more cigar smoking is occurring on the golf course. Simultaneous golfing and smoking gives rise to the need for further accessories. For example, there is typically no where to rest a burning cigar when swinging a golf club. Conversely, there is typically no where to place a golf club, presuming that the golfer wants to keep the handle out of the grass, while lighting and smoking a cigar.

Based on the above, there exists a need for an effective tool which can perform the above-discussed functions. Since space is at a premium on the links, it would also be desirable to provide all of those functions in a single tool wherein the single tool is collapsible into a compact, even stylish package.

SUMMARY OF THE INVENTION

It is accordingly an object of the present invention to provide a multi-function golfer's cigar tool which combines a cigar cutter and a turf repair tool in a compact unit.

It is another object of the present invention to provide such a multi-function golfer's cigar tool which includes a cigar holder.

It is yet another object of the present invention to provide such a multi-function golfer's cigar tool which provides a club handle support.

To that end, a multi-function golfer's cigar tool includes a body having a cigar cutter including a blade movably mounted therein and an arrangement for repairing a ball mark on a golf course associated with the body for repairing turf indentations caused by golf balls, the ball mark repair arrangement including at least one prong extending away from the body for engaging turf for smoothing thereof.

It is preferred that the cigar cutter include a handle mounted to the blade for manual movement of the blade within the body and a cigar aperture for disposing the tip of a cigar therein, the cigar aperture being positioned for movement of the blade thereacross for cutting a cigar tip disposed within the aperture.

It is further preferred that the arrangement for repairing a ball mark on a golf course be hingedly mounted to the body for folding movement between stowage position wherein the at least one prong is closely adjacent to the body and a use position wherein the at least one prong extends away from the body for turf engagement. It is additionally preferred that the arrangement for repairing a ball mark on a golf course include two prongs and a support base with the prongs being separated by a spacing and projecting away from the support base with the support base being hingedly mounted to the body using a hinge mounted to the support base and the body for folding movement of the arrangement for repairing a ball mark on a golf course.

Preferably, the present invention includes an arrangement for supporting a cigar with the cigar supporting arrangement being formed in the body. It should be noted that the present invention is adapted for cigars. Nevertheless, the cigar support means are equally effective to support a cigarette, or even a pipe. It is preferred that the arrangement for supporting a cigar include a cigar support groove formed on an upper surface of the body and wherein the arrangement for repairing a ball mark on a golf course includes a support base and at least one prong formed integrally therewith with the prong projecting away from the support base with the support base being hingedly mounted to the body using a hinge mounted to the support base and the body for folding movement of the arrangement for repairing a ball mark on a golf course, the folding movement being stoppable at a position wherein the at least one prong projects in a perpendicular relationship with the body for insertion of the at least one prong into the ground to provide a substantially, horizontally oriented cigar support groove for supporting a cigar therein.

The present invention further preferably includes an arrangement for supporting a golf club handle with the handle support arrangement being formed in the body. Preferably, the arrangement for supporting a golf club handle includes a golf club support indentation formed in one end of the body. Further, the arrangement for repairing a ball mark on a golf course includes a support base and at least one prong formed integrally therewith, the prong projecting away from the support base with the support base being hingedly mounted to the body using a hinge mounted to the support base and the body for folding movement of the arrangement for repairing a ball mark on a golf course, the folding movement being stoppable at a position wherein the at least one prong projects at an angular relationship with the body for insertion of the at least one prong into the ground to provide a stable support for the handle of a golf club.

It is further preferred that the arrangement for supporting a golf club handle include an indentation formed in the support base adjacent the hinge. Additionally, the support base may have an opening formed therein for a user to insert a finger thereinto to stabilize the tool when cutting a cigar tip.

DESCRIPTION OF THE PREFERRED EMBODIMENT

Figure 1:
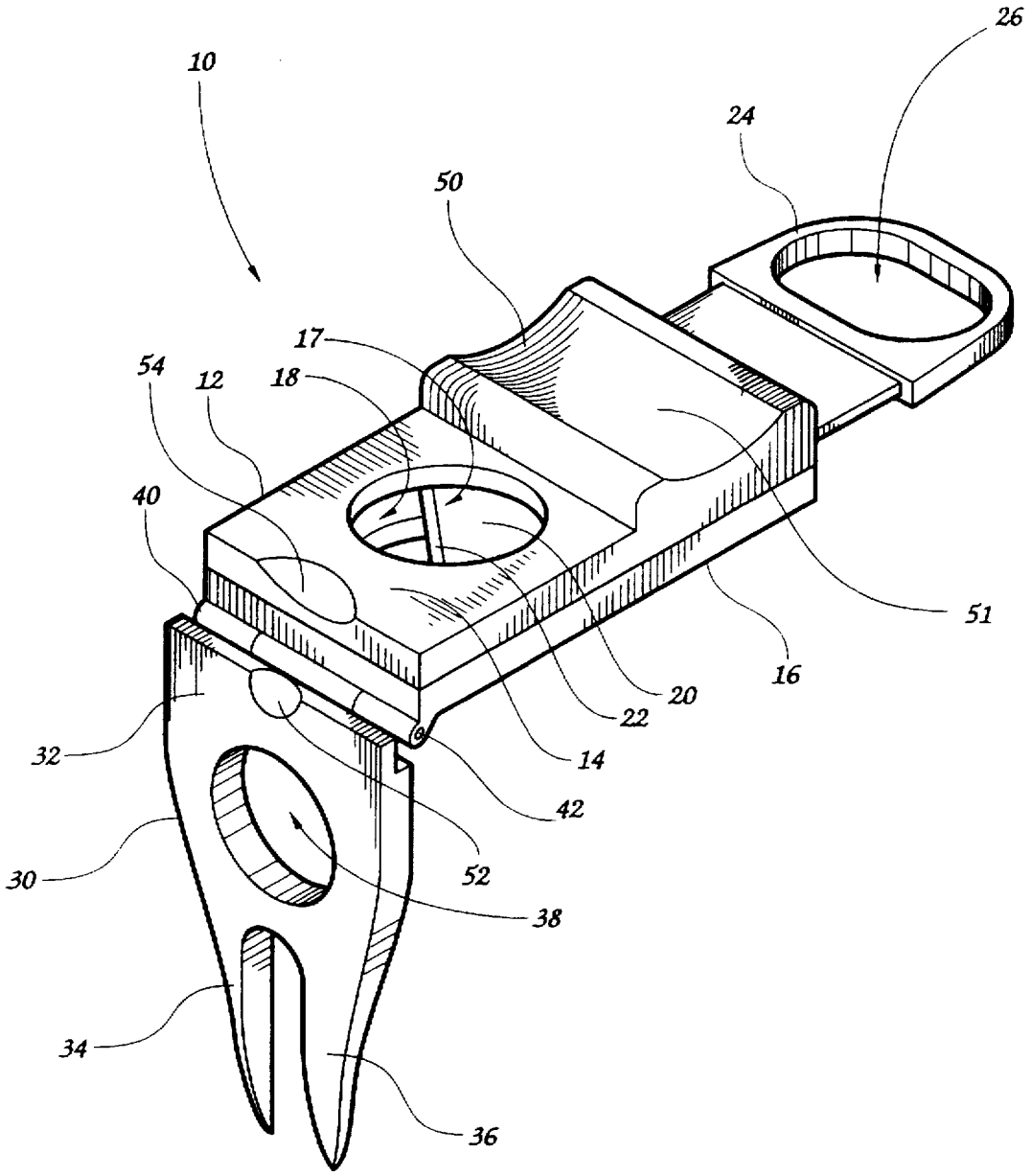
FIG. 1 is a perspective view of a multi-function golfer's cigar tool according to the preferred embodiment of the present invention.

Turning now to the drawings, and more particularly to FIG. 1, a multi-function golfer's cigar tool according to the preferred embodiment of the present invention is illustrated generally at 10 and includes a cutter body 12 formed as a generally flat rectangular member having a contoured top surface 14 and a generally flat bottom surface 16. The cutter body 12, as well as the remainder of the tool, may be formed of plastic, wood or may even be formed of precious metal. Further, any combination of plastic, wood, precious or non-precious metal may be employed for construction of various portions of the device. For instance, the body may be formed of wood while the prongs may be formed of stainless steel. Other combinations of materials are available to the artisan and it will be appreciated that the choice of materials may be based on function, as in the case of the prongs, or aesthetics as in the case of the body and turf tool being formed of precious metal. In any event, the present invention is susceptible to being formed from a wide range of materials.

The cutter body 12 includes a slot 18 formed lengthwise therein. The inner blade slot 18 extends from one open end of the body 12 into a terminal position within the body 12. A generally flat, guillotine-like blade 20 is disposed within the slot 18 and includes an angularly oriented edge 22 for cutting cigar tips. A handle 24 is formed as a generally D-shaped member having an opening 26 defined therein for finger engagement by a user. The handle 24 is formed slightly thicker and wider than the blade 20 to act as a stop member for the blade 20 moving in the slot 18. An opening 20 is formed in the device to extend from the top surface 14 to the bottom surface 16 to allow access to the blade 20 by a cigar tip. The cutter body 12 is formed with at least two surface features which will be explained in greater detail hereinafter.

Figure 3:
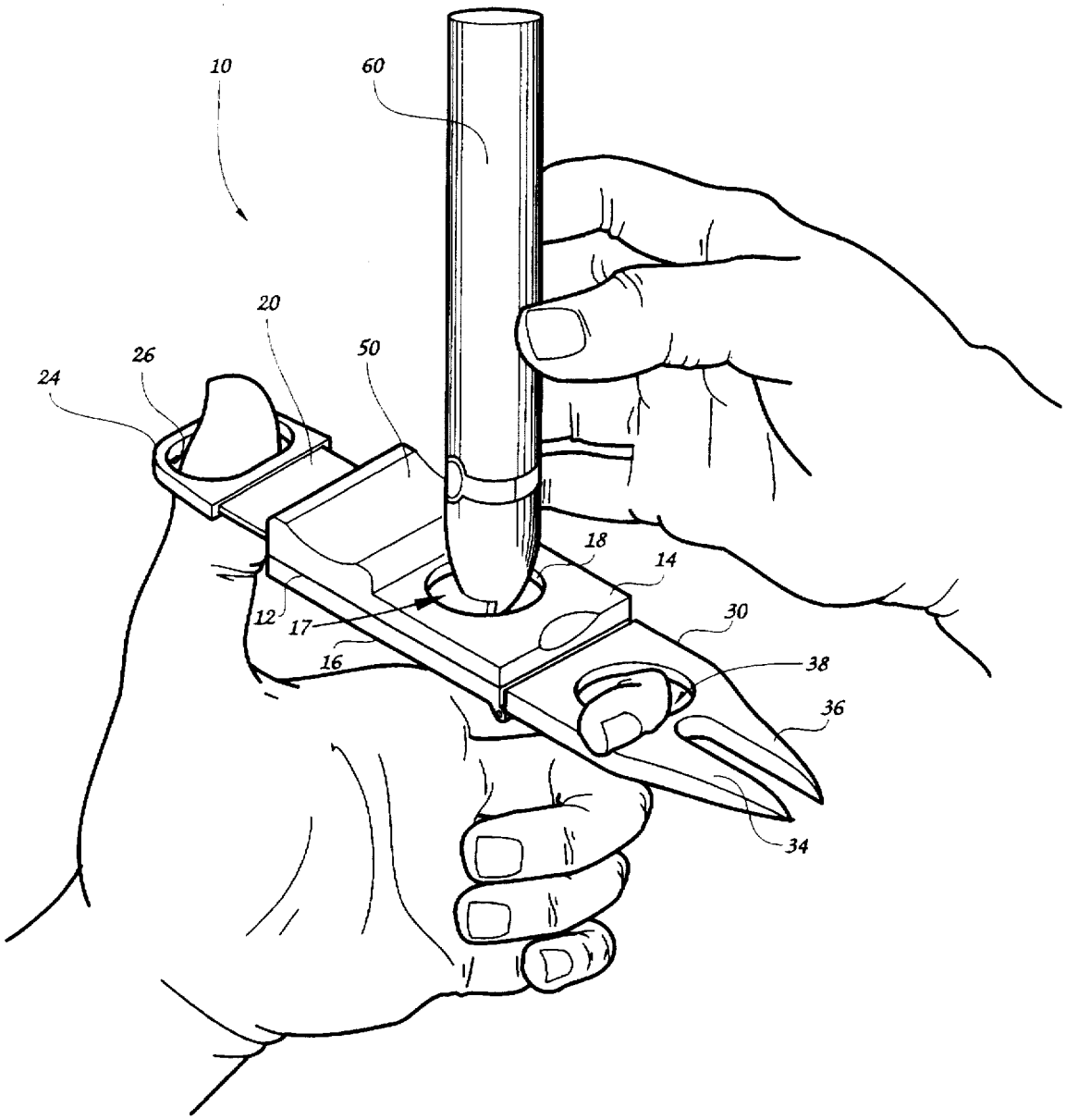
FIG. 3 is a perspective view of the multi-function golfer's cigar tool in use as a cigar cutter.

The multi-function golfer's cigar tool of the present invention additionally includes a turf repair tool which is attached to the cutter body 12. The turf repair tool 30 includes a support base 32 which is formed as a contoured member approximately the same width as the cutter body 12 and is joined thereto using a hinge 40 and a hinge pin 42. The turf repair tool 30 also includes two integrally formed, spaced prongs 34, 36 which project outwardly from the support base 32 with the side of the turf repair tool 30 being tapered from a maximum width at the support base 32 to narrow points on each prong 34, 36. A central opening 38 is formed in the support base 32 to accept the finger of a user for stabilizing the unit during cigar cutting as seen in FIG. 3. The support base 32 also includes at least one surface feature which will be explained in greater detail hereinafter.

Figure 2:
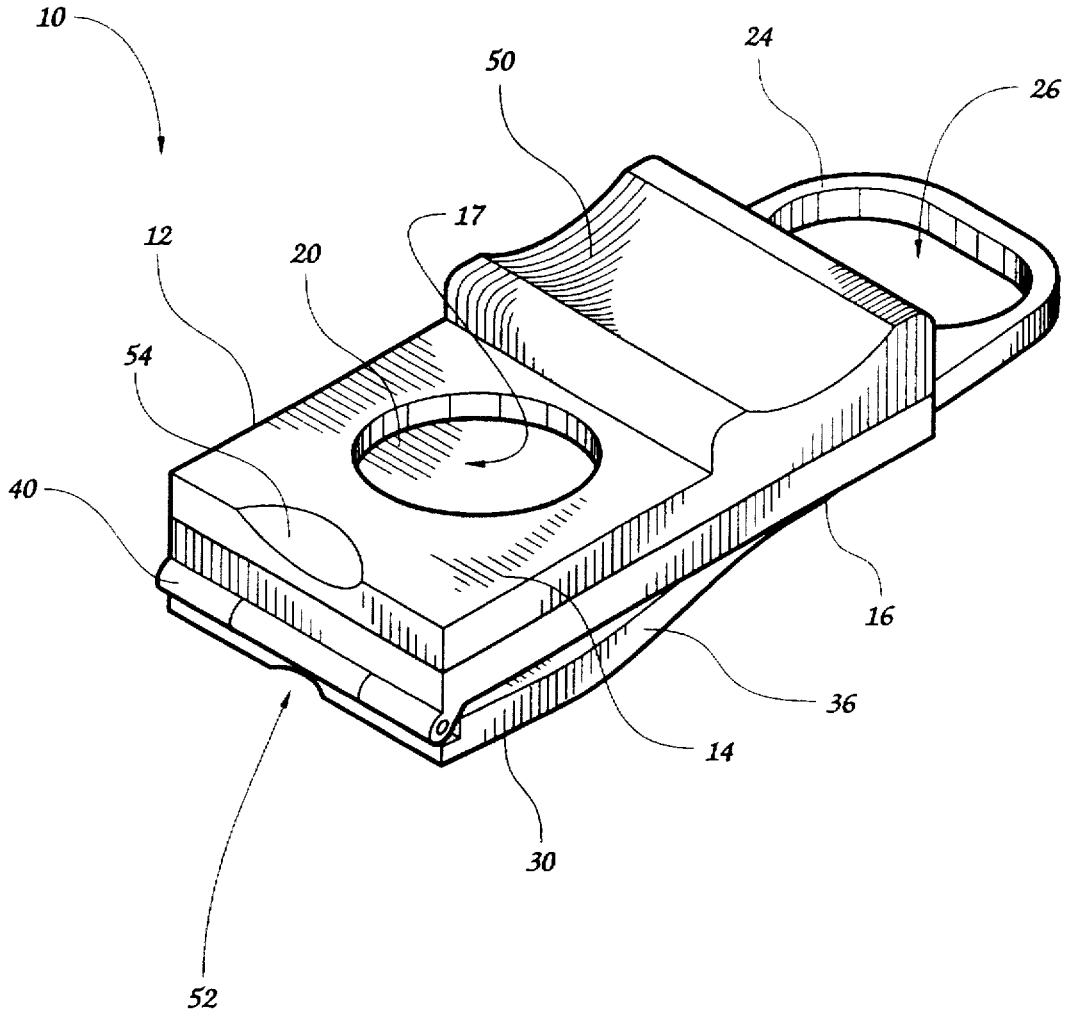
FIG. 2 is a perspective view of the multi-function golfer's cigar tool illustrated in FIG. 1 shown in a folded position for stowage.

The hinge 40 makes the unit foldable between a use position, seen in FIG. 1 and a folded, stowage position as seen in FIG. 2. It should be noted that the use position illustrated in FIG. 1 illustrates the turf repair tool 30 extending away from the body 12 at approximately a 90° angle. It will be appreciated by those skilled in the art of turf repair that the turf repair tool 30 will fold into a more parallel relation with the cutter body 12, extending outwardly therefrom with the prongs projecting away from the cutter body 12. It is in this position that effective turf repair can be accomplished. Since the turf repair function of the present invention is widely known, a broad description of turf repair using the tool will not be forthcoming.

As previously stated, there are several surface features associated with the present invention. Returning now to the body 12, and FIG. 1, a cigar support groove 50 is formed in an upper surface thereof intermediate the handle 24 and the cigar opening 20. The support groove 50 is a generally curved indentation formed as a contoured raised platform projecting upwardly from the upper surface 14 of the cutter body 12. The support groove 50 acts as a cradle for any cigar for which the user needs support. As previously stated, the cigar support groove is equally adaptable to support cigarettes. Further, the present invention is adaptable as an advertising display medium. As illustrated in FIG. 1, a corporate logo 51 may be printed within the cigar support groove 50. Alternately, the cigar support groove 50 may be formed over the cigar access opening 17 with the opening 17 extending through the groove 50. This would leave a planar surface where the groove 50 exists in FIG. 1 for ease of logo application. In addition to corporate logos, it is anticipated that logos from sports teams, colleges, fraternities or other organizations can be applied to the body 12 of the present invention.

An indentation 54, provided for golf club handle support, is formed in an end of the cutter body 12 at a position oppositely that of the handle 24. A complimentary indentation 52 is likewise formed in the turf repair tool 30 at a position adjacent the junction of the turf repair tool 30 and the cutter body 12. These two indentations 52, 54 cooperate to provide a stabilized support for a golf club handle as will be seen in greater detail hereinafter.

In operation, the turf repair tool 30 may be folded away from the cutter body 12 moving it from a position illustrated in FIG. 2 through a position illustrated in FIG. 1 into an extended position illustrated in FIG. 3. While FIG. 3 is obviously provided for illustrating the manner of cutting a cigar tip, FIG. 3 also illustrates the orientation of the turf repair tool 30 relative to the cutter body 12 for use during turf repair. As previously stated, it is well known how to use such a pronged device for turf repair so that an extensive discussion of golf course turf repair is not warranted here. Generally, the prongs are used to push up and groom turf on the greens disrupted by the impact of a golf ball thereonto.

With continued reference to FIG. 3, the present invention is illustrated operating as a cigar cutter. Cigar smokers will appreciate that it is necessary to cut the tip off of a cigar in order to provide a complete airway for drawing air and smoke through the cigar during smoking. In FIG. 3, a portion of a user is shown with a thumb inside the handle opening 26 and an index finger inside the turf repair tool opening 38. The user's other hand is stabilizing a cigar 60 with a tip disposed within the opening 17 provided for such use. The user then squeezes the thumb toward the index finger which results in the blade 20 sliding within the slot 18 and engaging the cigar tip 60 with the blade edge 22 performing a cutting action on the cigar. Since the cigar opening 17 extends all the way through the body 12 the cigar remnant will drop away from the bottom surface 16 of the device 10. Once the tip is cut, the device 10 may be folded into the stowage position illustrated in FIG. 2 for later use.

Figure 4:
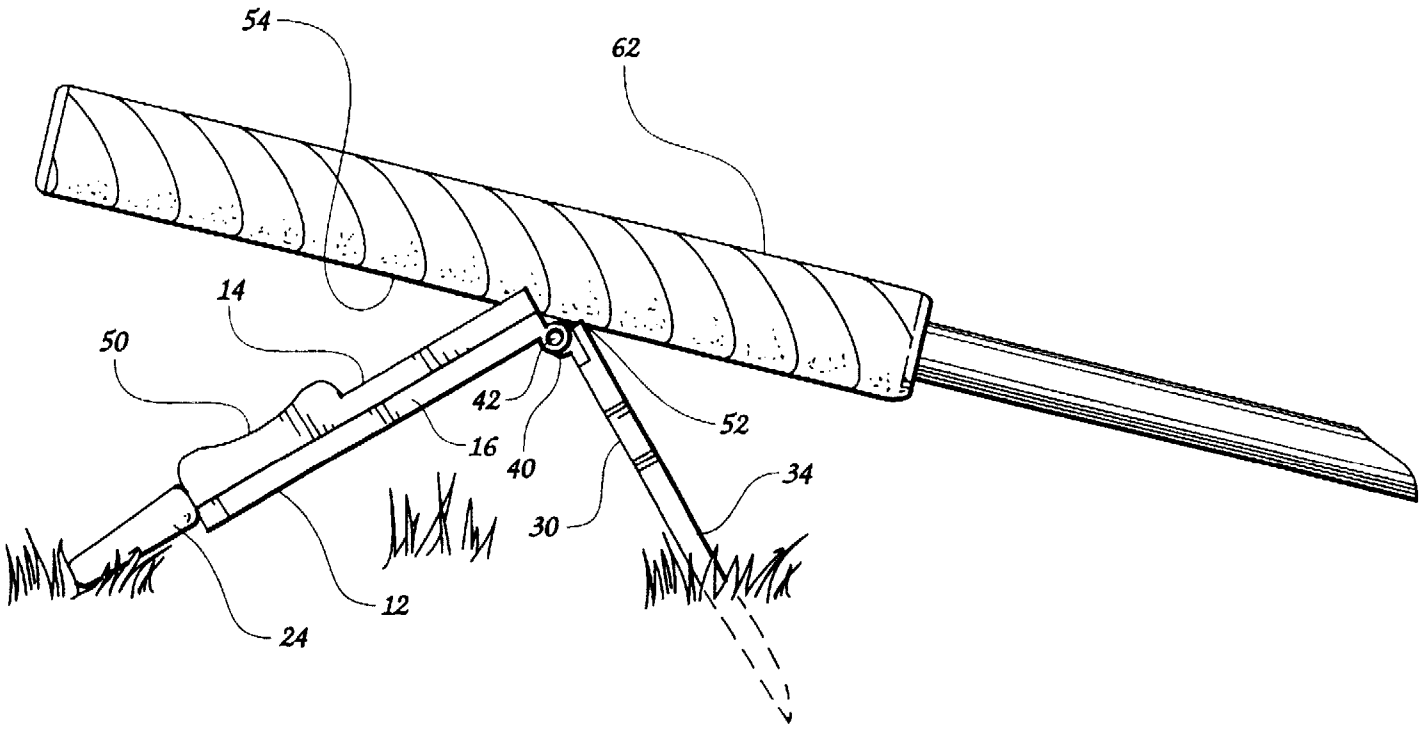
FIG. 4 is a side elevational view of the multi-function golfer's cigar tool in use as a handle support.

During smoking activity it may become necessary to support the golf club handle above the grass to prevent the handle from becoming contaminated by wet grass from morning dew or from turf watering operations or to keep the handle out of any chemically treated grass. As seen in FIG. 4, the device 10 is folded with the turf repair tool 30 extending away from the body 12 at a predetermined angular orientation which is illustrated in FIG. 4 as 90° but may be any other angular orientation to provide such an inverted V-shaped unit. The prongs 34, 36 are forced into the ground for a short distance with the device being supported on its opposite end by the handle 24. This configuration places the indentations 52, 54 in general alignment and the golf club handle 62 may rest in the indentations 52, 54 with the club head (not shown) providing support at the other end of the club. As may be expected, once the golfer is ready to commence golfing, the club is lifted away from the device 10 and the device 10 may be folded in a manner illustrated in FIG. 2 for stowage.

Figure 5:
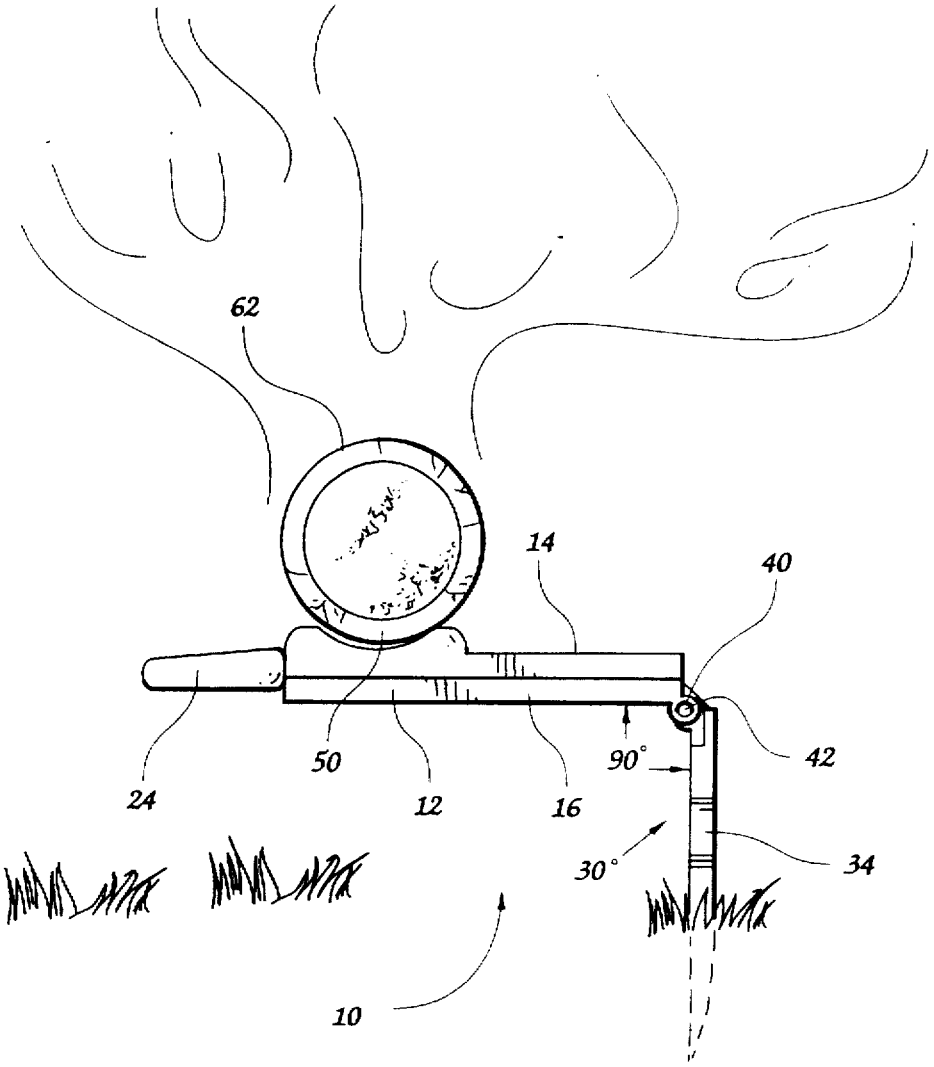
FIG. 5 is a side elevational view of the multi-function golfer's cigar tool used as a cigar support.
Figure 6:
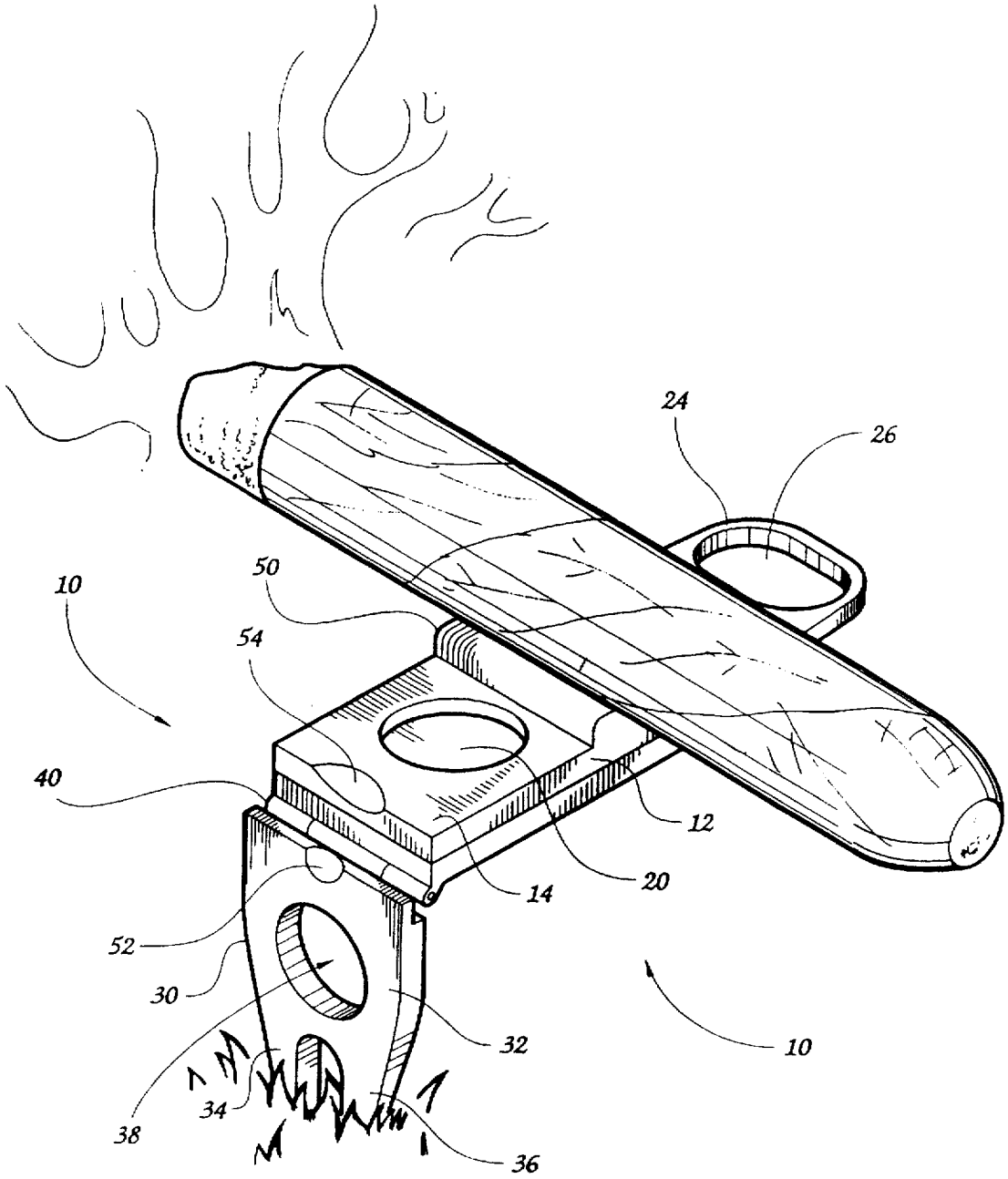
FIG. 6 is a perspective of the multi-function golfer's cigar tool as a cigar support as illustrated in FIG. 5.

When it comes time for the golfer to take his turn with a swing, it may become necessary to support the cigar. As may be expected, the burning end of a cigar can be detrimental to golfing accessories and, if leaves or other woodland debris are present, a genuine fire hazard exists. Therefore, the present invention 10 provides a cigar support stand as illustrated in FIGS. 5 and 6. In FIG. 5, it is seen that the device 10 is folded with the turf repair tool 30 extending in a 90° relationship with the body 12 with the prongs 34, 36 projecting into the ground for a short distance. It will be appreciated by those skilled in the art that the maintenance of the 90° relationship may be accomplished by providing indentations within the hinge at particular positions or, by merely relying on friction between the hinge components. In any event, once the 90° relationship is attained and the prongs 34, 36 inserted into the ground, the body 12 extends away from the turf repair tool 30 in a generally horizontal manner. Accordingly, a cigar 62 may be disposed within the cigar support groove 50 where it is cradled in a position best seen in FIGS. 5 and 6. As seen in FIG. 6, the cigar 62 includes portions extending away from the body 12 of the device 10 in either direction. The device 10 therefore keeps the blazing cigar tip off of the ground and the cigar at the ready for smoking once the golf swing is concluded.

By the above, the present invention provides a simple, compact and stylish device thereby providing a golfer with a multi-functional tool including a turf repair tool, a cigar cutter, a cigar support stand, and a golf club support stand.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A multi-function golfer's cigar tool comprising:

a body having a cigar cutter including a blade movably mounted therein and means for repairing a ball mark on a golf course associated with said body for repairing turf indentations caused by golf balls, said ball mark repair means including at least one prong extending away from said body for engaging turf for smoothing thereof, said means for repairing a ball mark on a golf course being hingedly mounted to said body for folding movement between a stowage position wherein said at least one prong is closely adjacent said body and a use position wherein said at least one prong extends away from said body for turf engagement.

2. A multi-function golfer's cigar tool according to claim 1 wherein said cigar cutter includes a handle mounted to said blade for manual movement of said blade within said body and a cigar aperture for disposing the tip of a cigar therein, said cigar aperture being positioned for movement of said blade therethrough for cutting a cigar tip disposed within said aperture.

3. A multi-function golfer's cigar tool according to claim 1 wherein said means for repairing a ball mark on a golf course includes two prongs and a support base, said prongs being separated by a spacing and projecting away from said support base with said support base being hingedly mounted to said body using a hinge mounted to said support base and said body for folding movement of said means for repairing a ball mark on a golf course.

4. A multi-function golfer's cigar tool according to claim 1 and further comprising means for supporting a cigar, said means for supporting a cigar being formed in said body.

5. A multi-function golfer's cigar tool according to claim 4 wherein said means for supporting a cigar includes a cigar support groove formed on an upper surface of said body and wherein said means for repairing a ball mark on a golf course includes a support base and at least one prong formed integrally therewith, said prong projecting away from said support base with said support base being hingedly mounted to said body using a hinge mounted to said support base and said body for folding movement of said means for repairing a ball mark on a golf course, said folding movement being stoppable at a position wherein said at least one prong projects in a perpendicular relationship with said body for insertion of said at least one prong into the ground to provide a substantially horizontally oriented cigar support groove for supporting a cigar therein.

6. A multi-function golfer's cigar tool according to claim 1 and further comprising means for supporting a golf club handle, said means for supporting a golf club handle being formed in said body.

7. A multi-function golfer's cigar tool according to claim 6 wherein said means for supporting a golf club handle includes a golf club support indentation formed in one end of said body and wherein said means for repairing a ball mark on a golf course includes a support base and at least one prong formed integrally therewith, said prong projecting away from said support base with said support base being hingedly mounted to said body using a hinge mounted to said support base and said body for folding movement of said means for repairing a ball mark on a golf course, said folding movement being stoppable at a position wherein said at least one prong projects in an angular relationship with said body for insertion of said at least one prong into the ground to provide a stable support for the handle of a golf club.

8. A multi-function golfer's cigar tool according to claim 3 and further comprising means for supporting a golf club handle, said means for supporting a golf club handle being formed in said support base.

9. A multi-function golfer's cigar tool according to claim 8 wherein said means for supporting a golf club handle includes a golf club support indentation formed in said support base adjacent said hinge and wherein said means for repairing a ball mark on a golf course includes a support base and at least one prong formed integrally therewith, said prong projecting away from said support base with said support base being hingedly mounted to said body using a hinge mounted to said support base and said body for folding movement of said means for repairing a ball mark on a golf course, said folding movement being stoppable at a position wherein said at least one prong projects in an angular relationship with said body for insertion of said at least one prong into the ground to provide a stable support for the handle of a golf club.

10. A multi-function golfer's cigar tool according to claim 1 wherein said support base has an opening formed therein for a user to insert a finger thereinto to stabilize said tool when cutting a cigar tip.

11. A multi-function golfer's cigar tool comprising:

a body having a cigar cutter including a blade movably mounted therein includes a handle mounted to said blade for manual movement of said blade within said body and a cigar aperture formed in said body for disposing the tip of a cigar therein, said cigar aperture being positioned for movement of said blade therethrough for cutting a cigar tip disposed within said aperture;

means for repairing a ball mark on a golf course including two prongs and a support base, said prongs being separated by a spacing and projecting away from said support base with said support base being hingedly mounted to said body using a hinge mounted to said support base and said body for folding movement between a stowage position wherein said a prongs are closely adjacent said body and a use position wherein said prongs extend away from said body for turf engagement for repairing turf indentations caused by golf balls;

means for supporting a cigar including a cigar support groove formed on an upper surface of said body and wherein said folding movement of said means for repairing a ball mark on a golf course being stoppable at a position wherein said one prongs projects in a perpendicular relationship with said body for insertion of said prongs into the ground to provide a substantially horizontally oriented cigar support groove for supporting a cigar therein; and means for supporting a golf club handle including a golf club support indentation formed in one end of said body with said folding movement of said means for repairing a ball mark on a golf course being stoppable at a position wherein said prongs project in an angular relationship with said body for insertion of said prongs into the ground to provide a stable support for the handle of a golf club.

12. A multi-function golfer's cigar tool according to claim 11 and further comprising second means for supporting a golf club handle, said second means for supporting a golf club handle being formed in said support base.

13. A multi-function golfer's cigar tool according to claim 12 wherein said second means for supporting a golf club handle includes a golf club support indentation formed in said support base adjacent said hinge.

* * * * *